US009440789B2

(12) United States Patent
Moayed Sabeti

(10) Patent No.: US 9,440,789 B2
(45) Date of Patent: Sep. 13, 2016

(54) PORTOTRASH (PORTABLE PERSONAL GARBAGE STORAGE/DISPOSAL UNIT)

(71) Applicant: Elaheh Moayed Sabeti, Woodland Hills, CA (US)

(72) Inventor: Elaheh Moayed Sabeti, Woodland Hills, CA (US)

( * ) Notice: Subject to any disclaimer, the term of this patent is extended or adjusted under 35 U.S.C. 154(b) by 0 days.

(21) Appl. No.: 14/256,594

(22) Filed: Apr. 18, 2014

(65) Prior Publication Data

US 2014/0312185 A1 Oct. 23, 2014

Related U.S. Application Data

(60) Provisional application No. 61/814,118, filed on Apr. 19, 2013.

(51) Int. Cl.
*B65B 67/12* (2006.01)
*B65F 1/14* (2006.01)
*B65B 67/04* (2006.01)

(52) U.S. Cl.
CPC ..... *B65F 1/1415* (2013.01); *B65B 67/04* (2013.01); *B65B 67/12* (2013.01); *B65B 67/1205* (2013.01)

(58) Field of Classification Search
CPC ..... B65B 67/12; B65B 67/04; B65B 67/00; B65B 67/125; B65B 67/1205; B65B 2067/1261; B65B 67/1238; B65B 67/1255; B65B 67/1227; B65B 67/1233; B65F 1/141; B65F 1/1415; B65F 2240/138; B65F 1/10
USPC ..... 248/95, 99, 100, 101
See application file for complete search history.

(56) References Cited

U.S. PATENT DOCUMENTS

| | | | | | |
|---|---|---|---|---|---|
| 965,737 | A * | 7/1910 | Parrish | 248/94 | |
| 3,627,242 | A * | 12/1971 | Vandermast | 248/97 | |
| 4,157,801 | A * | 6/1979 | Elmer | 248/97 | |
| 4,413,800 | A * | 11/1983 | Kelson | 248/99 | |
| 4,705,246 | A * | 11/1987 | Wolf | B65B 67/12 141/390 | |
| 4,946,118 | A * | 8/1990 | Hastings | 248/97 | |
| 5,060,893 | A * | 10/1991 | Halbert | 248/97 | |
| 5,183,226 | A * | 2/1993 | Brooks | 248/97 | |
| 5,570,862 | A * | 11/1996 | Nugent | 248/97 | |
| 5,868,364 | A * | 2/1999 | MacMillan | 248/97 | |
| 5,881,975 | A * | 3/1999 | Bianco | 248/95 | |
| 5,967,469 | A * | 10/1999 | Wade | 248/100 | |
| 6,053,459 | A * | 4/2000 | Priefert et al. | 248/97 | |
| 6,199,802 | B1 * | 3/2001 | Scheibe, Sr. | 248/97 | |

(Continued)

*Primary Examiner* — Nkeisha Smith
(74) *Attorney, Agent, or Firm* — Adli Law Group P.C.

(57) ABSTRACT

The Portotrash garbage disposal unit comprises a hollow ring forming a mouth of the garbage disposal unit. Legs capable of connecting to and supporting the mouth and allowing the unit to stand in an upright standing position are provided. A bag that fits over and is kept in place by the hollow ring is provided and occupies at least some of the space formed in between the legs. Preferably, there are four legs identified as a first leg, a second leg, a third leg, and a fourth leg. The first and the third leg are connected to each other by a first connecting member forming a first leg pair, and the second and fourth legs are connected to each other by a second connecting member, forming a second leg pair. The first leg pair and the second leg pair are pivotally connected to each other through their respective connecting members. Hollow ring comprises a clasp or other fitting mechanism corresponding to each leg to which it connects. When in a completely folded position, the first leg is in touch with the second leg and the third leg is in touch with the fourth leg. Connecting members can be in the lower or middle portion of their corresponding legs. In one embodiment, the trash bag is made of plastic with odor control properties.

9 Claims, 4 Drawing Sheets

(56) References Cited

U.S. PATENT DOCUMENTS

| | | | | |
|---|---|---|---|---|
| 6,334,593 | B2 * | 1/2002 | Inoue | 248/95 |
| 6,446,919 | B1 * | 9/2002 | Tsui | 248/100 |
| 6,467,735 | B1 * | 10/2002 | Clinton | 248/97 |
| 6,520,457 | B1 * | 2/2003 | Yardley et al. | 248/99 |
| 6,588,620 | B1 * | 7/2003 | Thuma et al. | 220/489 |
| 6,823,883 | B1 * | 11/2004 | Sears | 135/128 |
| 6,994,301 | B1 * | 2/2006 | Fox | 248/97 |
| 7,222,825 | B2 * | 5/2007 | Gilbert | 248/95 |
| 7,284,732 | B1 * | 10/2007 | Lopa | 248/99 |
| 7,318,569 | B1 * | 1/2008 | Bilotta | 248/97 |
| 7,731,134 | B1 * | 6/2010 | Mutert | 248/99 |
| 8,287,189 | B1 * | 10/2012 | Ulloa-Parra | B65F 1/0006 383/61.4 |
| 8,322,663 | B2 * | 12/2012 | Bosik | 248/97 |
| 8,925,875 | B2 * | 1/2015 | Horvath | 248/99 |
| 2002/0171014 | A1 * | 11/2002 | Russell et al. | 248/99 |
| 2005/0061929 | A1 * | 3/2005 | Wood et al. | 248/99 |
| 2005/0103952 | A1 * | 5/2005 | Evans | 248/99 |
| 2007/0045483 | A1 * | 3/2007 | Johnson et al. | 248/99 |
| 2007/0181753 | A1 * | 8/2007 | Herlands | 248/99 |
| 2008/0302924 | A1 * | 12/2008 | Albert | 248/99 |
| 2010/0012794 | A1 * | 1/2010 | Dembowiak et al. | 248/99 |
| 2011/0168854 | A1 * | 7/2011 | Chen | 248/97 |
| 2012/0104188 | A1 * | 5/2012 | Andersen | 248/97 |
| 2012/0325984 | A1 * | 12/2012 | Moynihan et al. | 248/98 |

* cited by examiner

PORTOTRASH (PORTABLE PERSONAL GARBAGE STORAGE/DISPOSAL UNIT)

CROSS-REFERENCE TO RELATED PATENT APPLICATIONS

Embodiments of the present invention relate to U.S. Provisional Application Ser. No. 61/814,118, filed Apr. 19, 2013, entitled "PORTOTRASH (PORTABLE PERSONAL GARBAGE STORAGE/DISPOSAL UNIT)", the contents of which are incorporated by reference herein and which is a basis for a claim of priority.

BACKGROUND OF THE INVENTION

There are many instances when people need, but can't easily find, suitable means for disposing of their refuse. One example is campgrounds. In recent years, camping has become even more popular since it allows people, young and old alike, to enjoy fresh air and the beauty of nature and as a means for relaxation and fun. Although typical campgrounds do provide trash bins for disposing refuse, such cans are frequently located at a distance from the camper's location and thus does not allow ready access to them.

Even where public trash disposal means are nearby, many people may prefer to camp at a distance from public garbage bins for safety reasons due to their tendency to attract wild animals. In that regard, there are a number of animals commonly attracted by the smell of food and garbage such as bears, raccoons, birds and chipmunks and squirrels. Developed campgrounds are more likely to provide clearly marked garbage bins and employ staff, who empty the bins regularly for safety. Failure to properly store refuse while camping, picnicking or hiking can result in an animal encounter that is not only potentially dangerous but can create a big mess in people's campsite, including the destruction of expensive belongings.

A solution to this problem practiced by some campers is to carry paper and plastic bags to the campsite and to store refuse in the bags during their outdoor endeavors. Refuse so stored is then disposed of in a public bin or can. However, this solution is not very satisfactory since paper bags often get wet from the refuse placed in them and may not be able to hold the weight of the trash placed in them when being delivered to the trash can. Concerning plastic bags, such bags are inconvenient because of their inability to maintain a posture with the mouth open to receive trash. Rather, a plastic trash bag, by itself, stands in a collapsed closed position and the mouth of the bag needs to be opened each time trash is placed inside the bag. Further, when the plastic bag is more than half full, it tends to lay on a side which is the heavier side, causing trash, and especially liquids to spill out into the surrounding grounds.

Another approach to solving this problem is for campers to carry their household trash bins to the camp or picnic site. However, this approach is also unsatisfactory in that a conventional trash bin, especially one designed to hold a large bag, may be too sturdy or bulky to carry and may carry a foul smell if carried in a car or RV.

There is clearly a need for a trash collection and disposal mechanism that avoids the above deficiencies of the conventional trash collection and disposal on camping, picnic, hiking, and other outdoor endeavors.

SUMMARY OF THE INVENTION

According to an exemplary embodiment, the inventive portable garbage disposal unit (Portotrash) comprises a hollow ring forming a mouth of the unit through which trash is received. Legs capable of connecting to and supporting the hollow ring to stand in an upright position are provided. A bag fits over and is kept in place by the hollow ring and is encased by the legs. Preferably, there are four legs identified as a first leg, a second leg, a third leg, and a fourth leg. The first and the third leg are connected to each other by a first connecting member forming a first leg pair. The second and fourth legs are connected to each other by a second connecting member, forming a second leg pair. The first connecting member and the second connecting member are pivotally connected to each other. The hollow ring comprises a clasp or other fastening mechanism for connecting to each leg that supports it. When in a completely folded position, the first leg is in touch with the second leg and the third leg is in touch with the fourth leg. Connecting members are positioned in a lower portion of the legs.

In one embodiment, the trash bag is made of plastic with odor control properties. In another embodiment, the legs are foldable to allow for a more compact composure. In yet another embodiment, a lid is provided that fits over the mouth. When in a folded position, the inventive garbage unit can be carried using one hand.

DETAILED DESCRIPTION OF PREFERRED EMBODIMENTS

The various embodiments of the present invention will now be described in more detail by reference to the drawings.

Figure 1:
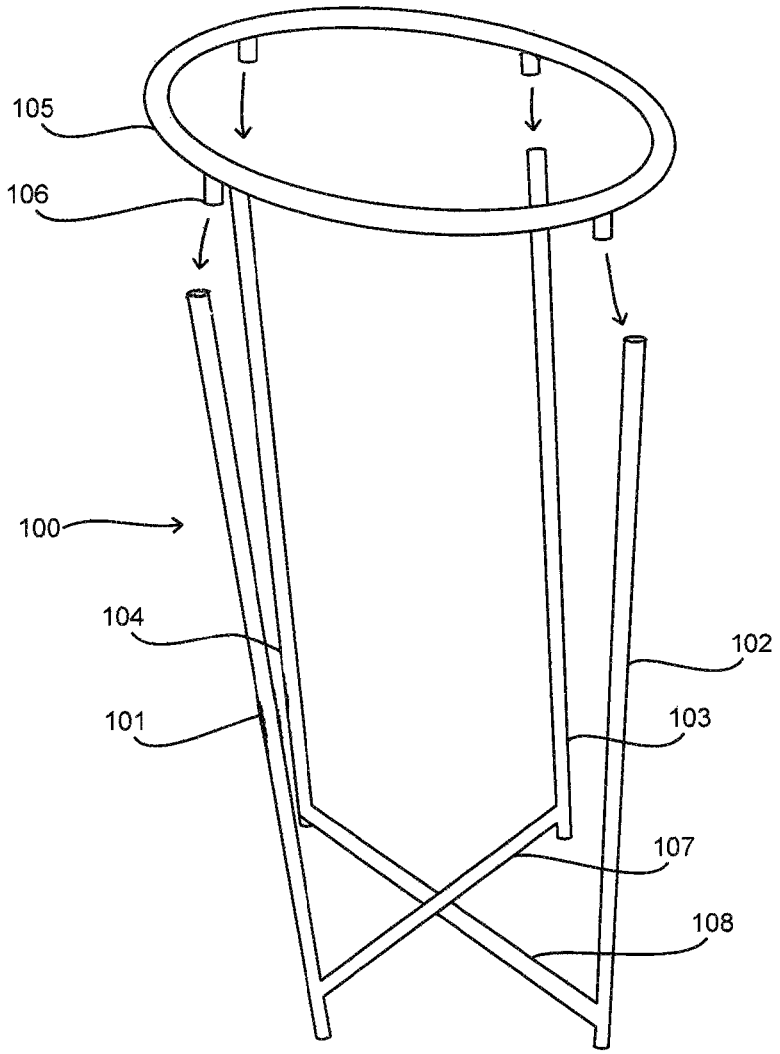
FIG. 1 is a schematic diagram of the inventive garbage disposal unit depicting basic elements and set up of the unit according to an exemplary embodiment of the present invention.

Referring to FIG. 1, the inventive "Portotrash" garbage disposal unit 100 comprises hollow ring 105 that forms the mouth of the unit through which it receives trash. Hollow ring 105 is preferably circular in shape but can be any other shape such as oval, square, rectangle, etc. Preferably, hollow ring 105 is made of aluminum, which is lightweight, yet sturdy and inexpensive, but it can be made of any other suitable material. Hollow ring includes extensions or protrusions 106 on its perimeter for the purpose of allowing it to connect to a base for support in an upright standing position. Hollow ring 105 attaches to legs 101, 102, 103 and 104. Preferably, legs are rods made of lightweight metal, but can be made of wood, plastic or any suitable material.

The first leg 101 and the third leg 103 are connected to each other through connecting member 107 and form a first leg pair. The second leg 102 and the fourth leg 104 are connected to each other through connecting member 108 and form a second leg pair. Preferably, connecting members

107 and 108 are each located on a lower portion of their corresponding legs. The first leg pair and the second leg pair are pivotally connected to each other through their respective connecting members 107 and 108.

Figure 2:
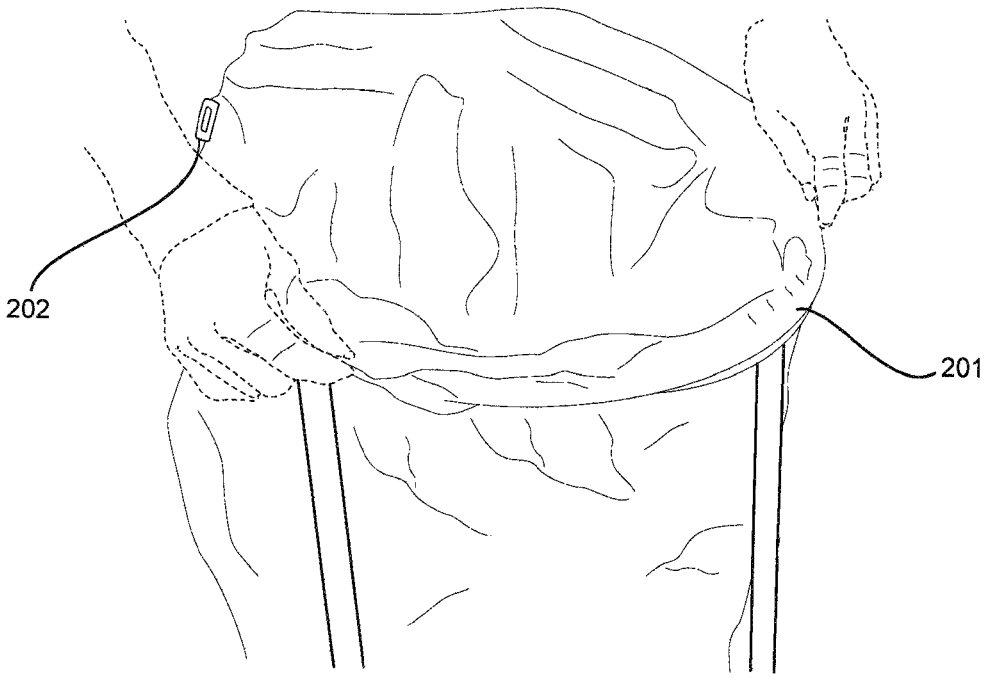
FIG. 2 is a schematic diagram of the inventive garbage disposal unit depicting the placement of a bag over the unit according to an exemplary embodiment of the present invention.

Referring to FIG. 2, trash bag 201 is shown being fitted over the hollow ring which forms the mouth of the inventive garbage disposal unit 200. Preferably, trash bag's position over the hollow ring is secured by string 202 that tightens the bag over the mouth to allow for a secure fit over the hollow ring. Preferably, trash bag is made of plastic. In one embodiment, the plastic is odor absorbing with the aim of preventing or minimizing attraction by animals and birds to the refuse inside the can.

Figure 3:
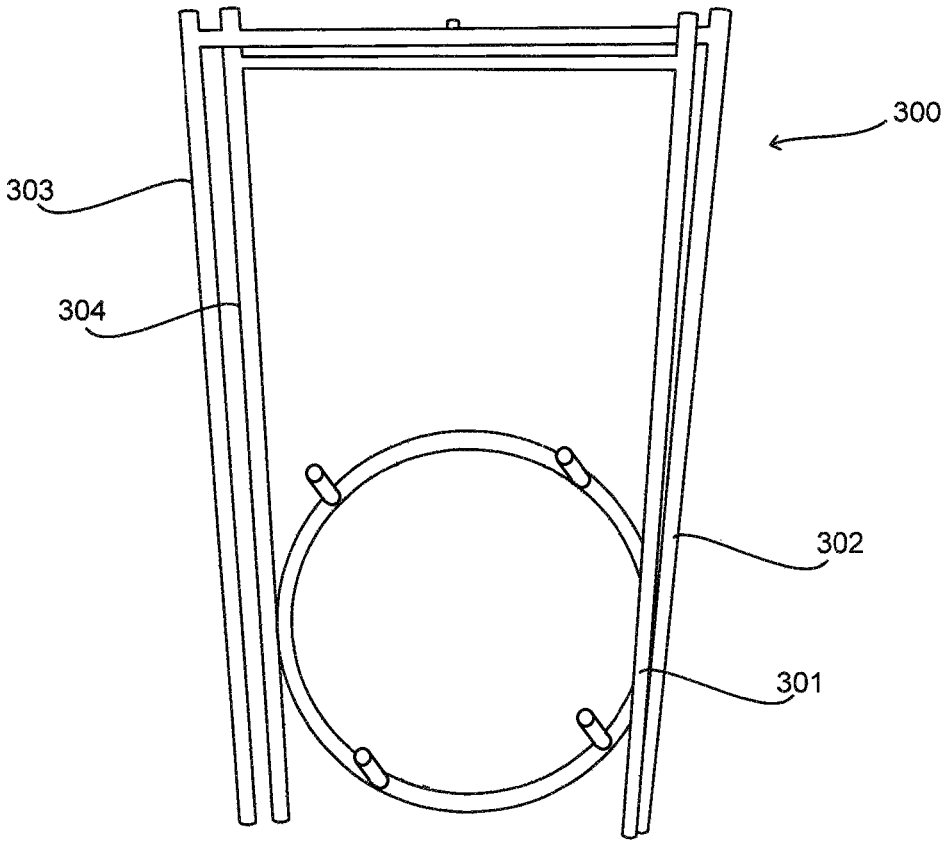
FIG. 3 is a schematic diagram of the inventive garbage disposal unit in a folded standing position according to an exemplary embodiment of the present invention.
Figure 4:
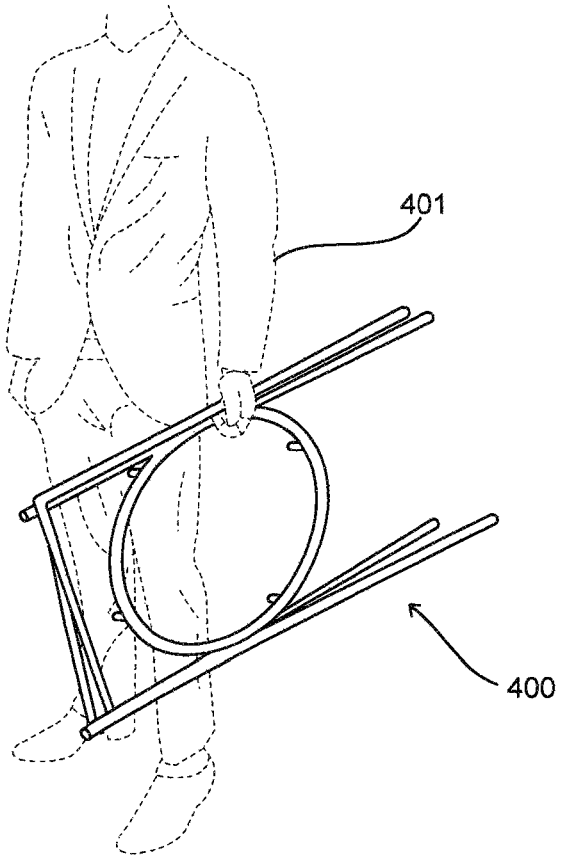
FIG. 4 is a schematic diagram of the inventive garbage disposal unit being carried in a folded position according to an exemplary embodiment of the present invention.

Referring to FIG. 3, the inventive Portotrash garbage disposal unit 300 is shown standing against a wall in a folded, upright leaning position. First leg 301 and second leg 302 are in physical proximity to each other. Similarly, in the folded position, second leg 303 and fourth leg 304 are physically proximate to each other. Hollow ring 305, forming the mouth of the unit, is separated from the legs and placed on the floor Referring to FIG. 4, the inventive Portotrash garbage disposal unit 400 is shown being carried in a folded position. User 401 is shown easily carrying the Portotrash garbage disposal unit 400 using one hand, leaving the other hand free to carry other belongings as needed.

Some of the advantages of the inventive Portotrash garbage disposal unit include easy portability and ease to transport. Another advantage is easy storage. Yet another advantage of the inventive Portotrash garbage disposal unit is its adaptability to various environments, indoor and outdoor, such as home, office, beaches, camping grounds, and the like.

While the foregoing written description of the invention enables one of ordinary skill to make and use what is considered presently to be some of the preferred embodiments of the invention, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A portable garbage disposal unit consisting of:

a circular hollow ring having four protrusions aligning on the circular hollow ring in equal distance forming a mouth of the garbage disposal unit for receiving refuse;

four legs removably connected to the four protrusions without locking mechanism and supporting the mouth to stand in an upright position;

a bag that fits over and kept securely in place by the mouth;

wherein the bag occupies at least some of a space formed in between the legs;

wherein a first and a third leg of the four legs are connected to each other by a first connecting member forming a first leg pair;

wherein a second leg and a fourth leg of the four legs are connected to each other by a second connecting member, forming a second leg pair; and wherein the first leg pair and the second leg pair are pivotally connected to each other through their respective connecting members.

2. The garbage disposal unit of claim 1, wherein in a folded position, the first leg pair and the second leg pair remain connected through the pivotal connection and are approximately in a same geometric plane.

3. The garbage disposal unit of claim 1, wherein each connecting member is positioned in a bottom portion of the legs which it connects.

4. The garbage disposal unit of claim 1, wherein each connecting member is positioned in a middle portion of the legs which it connects.

5. The garbage disposal unit of claim 1, wherein the hollow ring comprises protrusions around its perimeter corresponding to each leg to which it connects.

6. The garbage disposal unit of claim 1, wherein, when in a folded position, the first and second leg are in close proximity to each other and the second and the fourth leg are in close proximity to each other.

7. The garbage disposal unit of claim 1, wherein the legs are collapsible.

8. The garbage disposal unit of claim 1, wherein the hollow ring is collapsible.

9. The garbage disposal unit of claim 1, further comprising a lid that fits over the hollow ring.

* * * * *